US005558113A

United States Patent [19]

Casteel et al.

[11] Patent Number: 5,558,113

[45] Date of Patent: Sep. 24, 1996

[54] WIRE STRAND CLEANER

[75] Inventors: Ronald G. Casteel, Russell; Dennis E. Davis, Warren; Robert R. Johnson, Sheffield, all of Pa.

[73] Assignee: Osram Sylvania Inc., Danvers, Mass.

[21] Appl. No.: 203,977

[22] Filed: Mar. 1, 1994

[51] Int. Cl.[6] ..... B08B 3/08

[52] U.S. Cl. ..... 134/122 R; 134/64 R

[58] Field of Search ..... 134/64 R, 122 R; 266/112, 113, 114; 68/181 R; 239/580, 581.2, 582.1

[56] References Cited

U.S. PATENT DOCUMENTS

| | | | |
|---|---|---|---|
| 2,623,789 | 12/1952 | Bourner | 239/581.2 X |
| 2,676,844 | 4/1954 | Paasche | 239/582.1 X |
| 3,044,098 | 7/1962 | Stalson | 134/64 R X |
| 3,399,685 | 9/1968 | Jones et al. | 134/64 R |
| 4,064,884 | 12/1977 | Asp | 134/64 R X |
| 4,811,748 | 3/1989 | Murao et al. | 134/122 R |
| 4,813,605 | 3/1989 | Fuller | 239/582.1 X |

FOREIGN PATENT DOCUMENTS

| | | | |
|---|---|---|---|
| 401732 | 2/1974 | U.S.S.R. | 266/113 |

*Primary Examiner*—Philip R. Coe
*Attorney, Agent, or Firm*—William H. McNeill

[57] ABSTRACT

A wire strand cleaner employs a fluid detergent, a fluid rinse and an air dry under controlled agitation and turbulence to avoid the use of CFC's. The wire is pulled through the various stations in sequence, and the cleaning and rinse are accomplished by agitator components that are identical. Further, the wire is pulled through the cleaner in a straight line, thus avoiding the bending and stretching that usually accompanied ultrasonic cleaning.

4 Claims, 5 Drawing Sheets

WIRE STRAND CLEANER

TECHNICAL FIELD

This invention relates to wire strand cleaners and more particularly to such a cleaner that uses no CFC's (chlorofluorocarbons)

BACKGROUND ART

Prior art techniques for cleaning strand wire before annealing generally comprised pulling the wire strands through an ultrasonic degreaser containing Freon (a trade name for a group of CFC's. specifically, polyhalogenated hydrocarbons containing chlorine and fluorine such, for example, as trichlorofluoromethane). Some recent evidence has indicted the CFC's as a culprit in the depletion of the ozone layer and there has been strong world-wide emphasis on reducing or eliminating these compounds from industrial applications.

DISCLOSURE OF THE INVENTION

It is, therefore, an object of the invention to obviate the disadvantages of the prior art.

It is another object of the invention to enhance the operation of wire strand cleaning.

These objects are accomplished, in one aspect of the invention, by the provision of a wire strand cleaner that comprises a first work station for providing an aqueous detergent cleaning of the wire strand followed by a a second work station for rinsing the wire strand and a third work station for drying the strand.

In greater detail, the work stations each include at least one agitator component through which the strands pass while being subjected to the action of turbulent fluids; liquids in the case of the first two work stations, and a gas in the case of the third work station.

This cleaner eliminates the use of CFC's and is substantially more economical to operate. Additionally, all ingredients are biodegradable.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
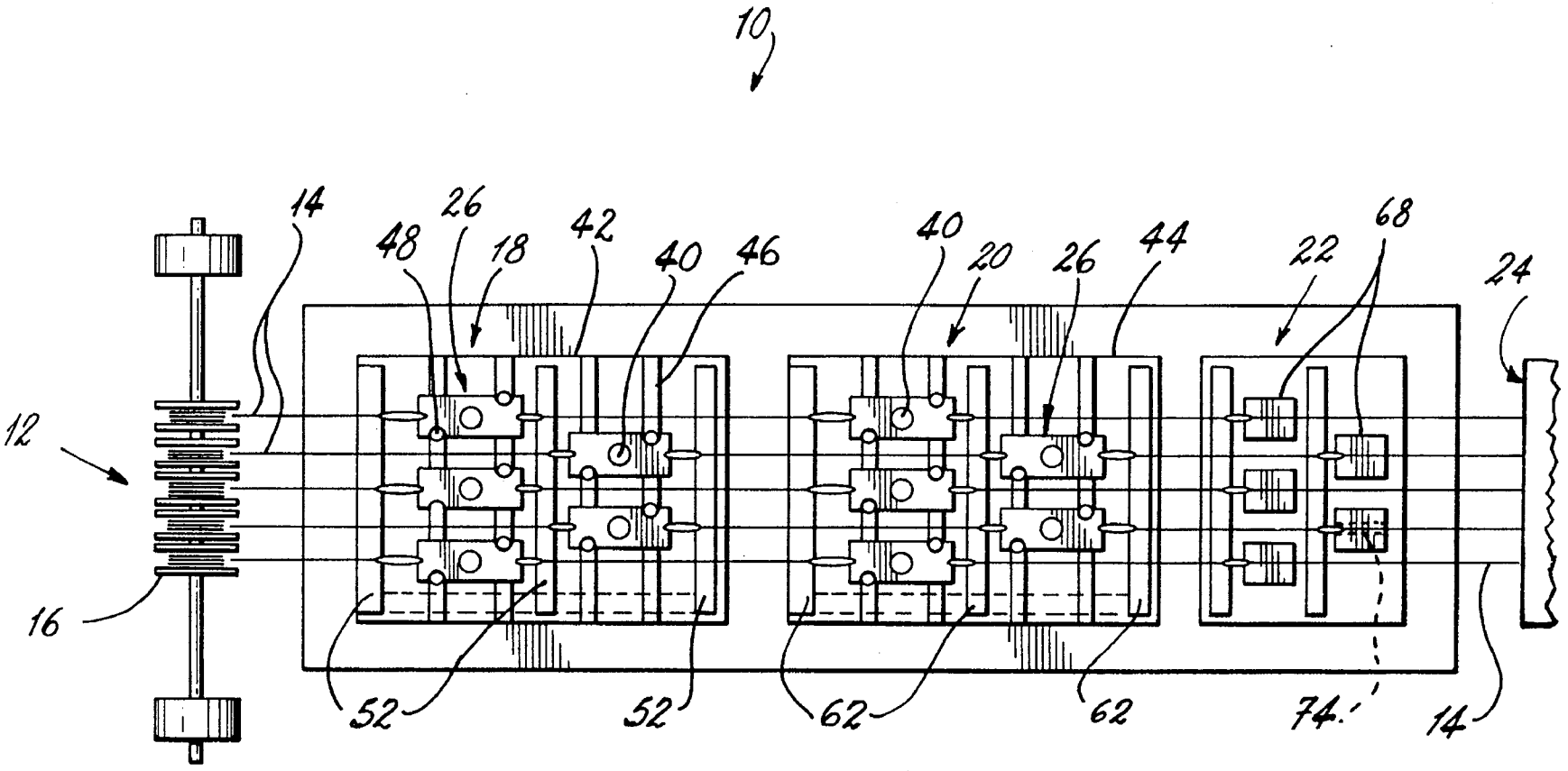
FIG. 1 is a diagrammatic plan view of an apparatus of the invention.
Figure 2:
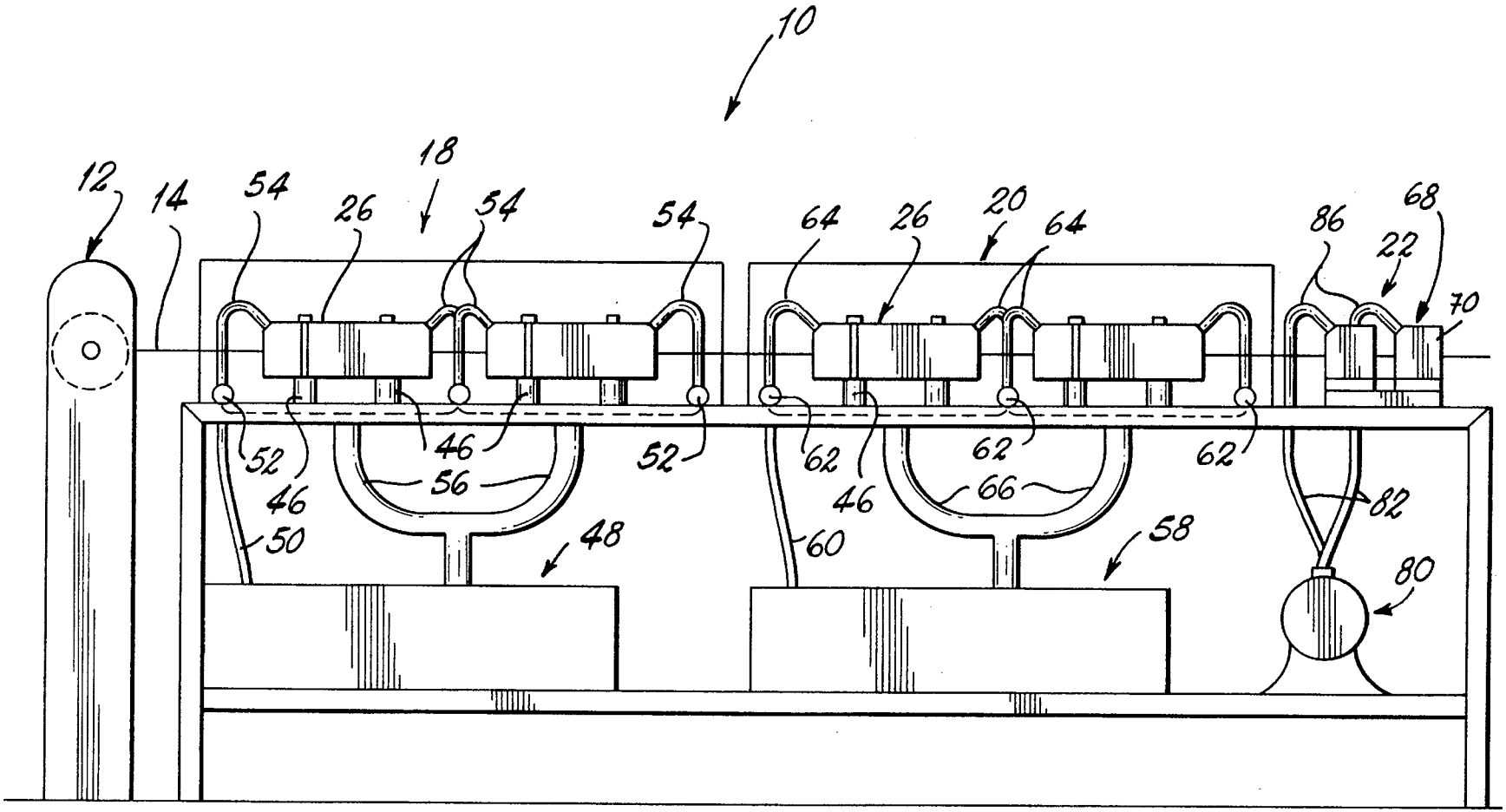
FIG. 2 is a diagrammatic elevational view thereof.

Referring now to the drawings with greater particularity, there is shown in FIG. 1 a wire strand cleaner 10 which has a supply 12 of wire strand 14. The supply can comprise a plurality of wire containing spools 16. The strand cleaner 10 has a first station 18 for providing an aqueaous detergent cleaning of the wire strands; a second station 20 for providing an aqueous rinse of the strands; a third station 22 for air drying the strands; and a wire feed 24 for moving the strands from the supply sequentially through the stations.

The first station 18 and the second station 20 are each provided with a plurality of agitator components 26. Each of the agitator components comprises a body 28 of a high density plastic such as Gar-dur, which is available from Garland Mfg. Co., 50 Water Street, Saco, Me 04072, The body 28 has a longitudinal axis 30 and a wire strand receiving bore 32 extending therethrough and coaxial with the longitudinal axis. First and second fluid receiving passages, 34, 36, respectively, are located at either end of the body and connect with bore 32 at an angle of less than 90° and greater than 0°. Each of the fluid receiving passages is provided with a fluid volume control 38 which can be in the form of an adjustable set screw.

Substantially equally positioned between the fluid receiving passages is a fluid releasing path 40, which is positioned normal to the longitudinal bore 32 and in communication therewith.

The first station 18, with its at least one agitatior component 26, and the second station 20, with its at least one component 26, are contained within fluid containing housings designated generally as 42 and 44, respectively.

Figure 3:
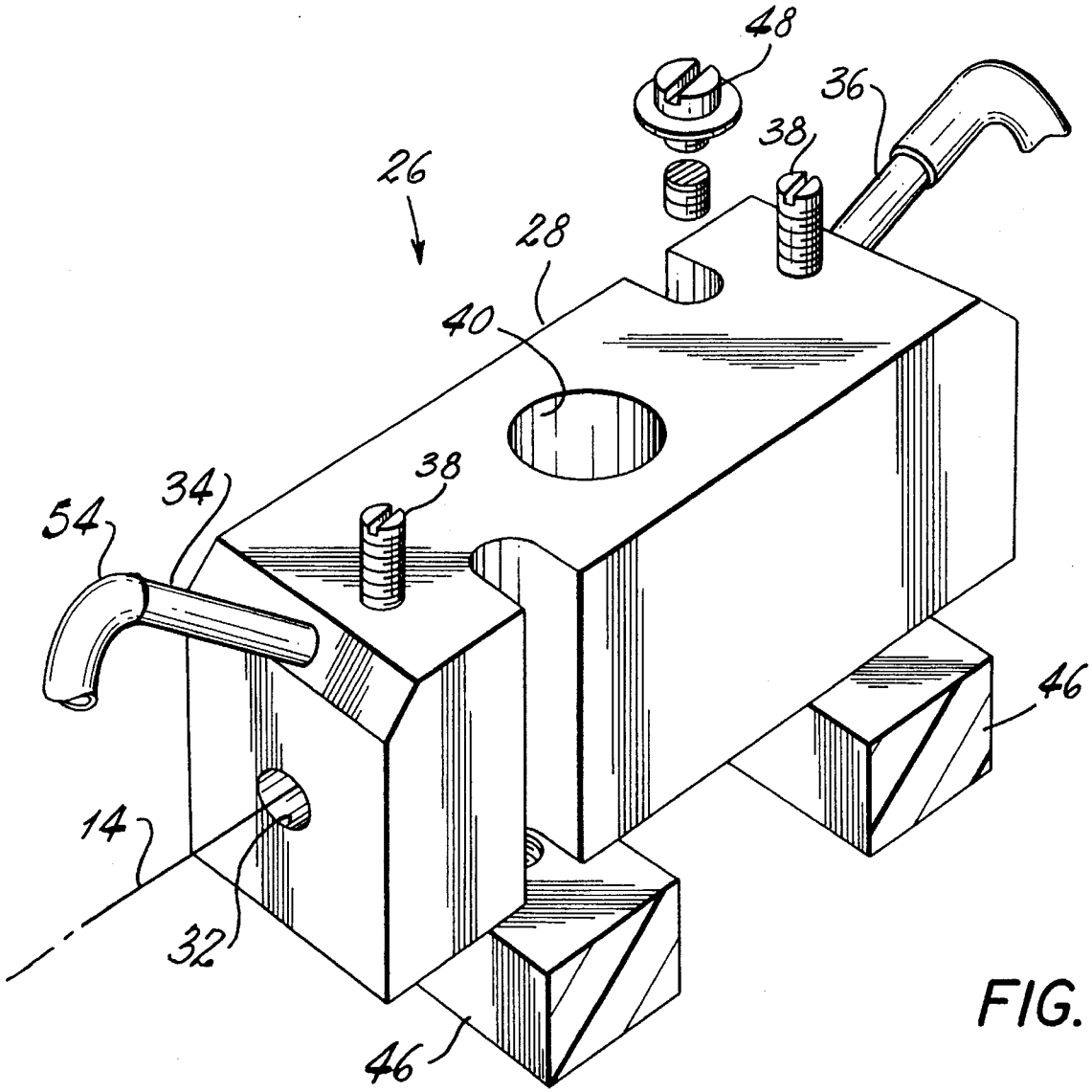
FIG. 3 is a perspective view of an agitator component of the invention.
Figure 4:
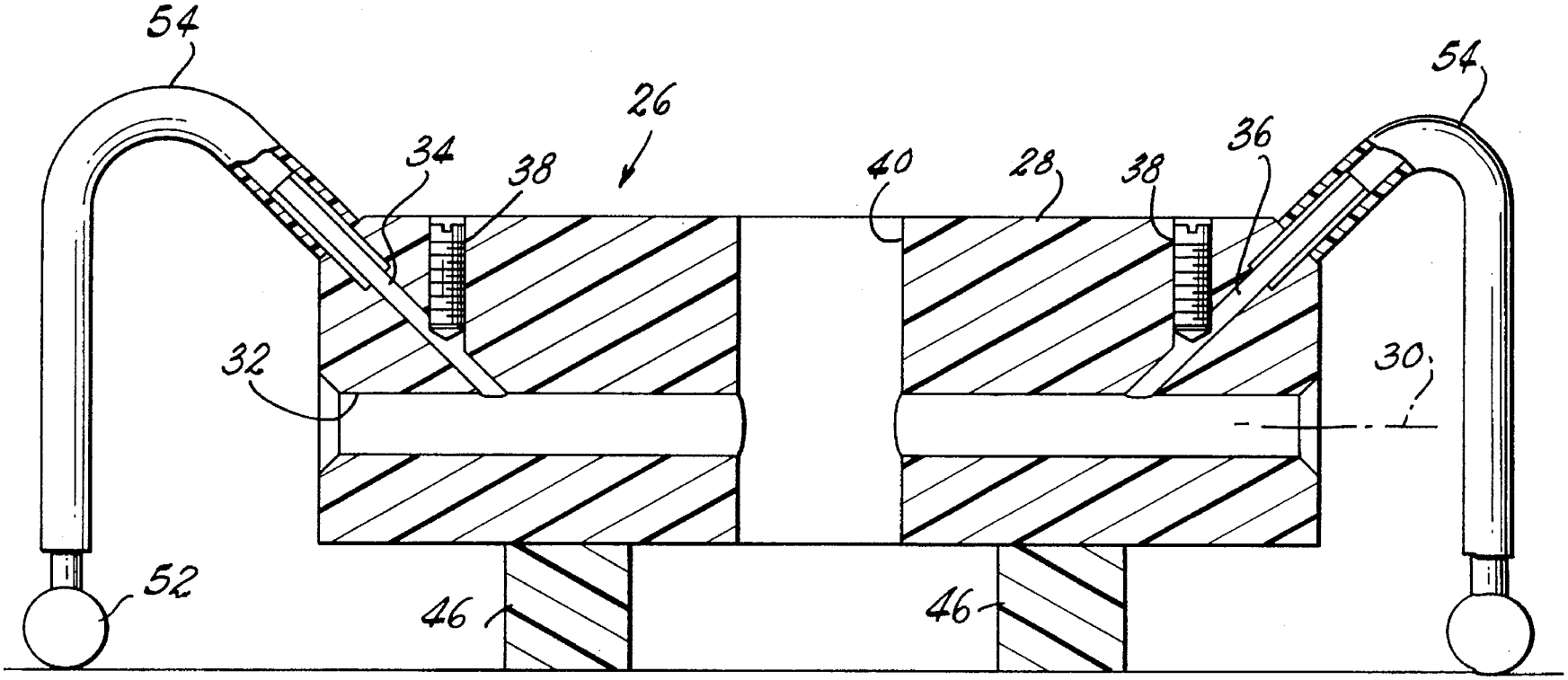
FIG. 4 is an elevational, sectional view of the agitator of FIG. 3.
Figure 5:
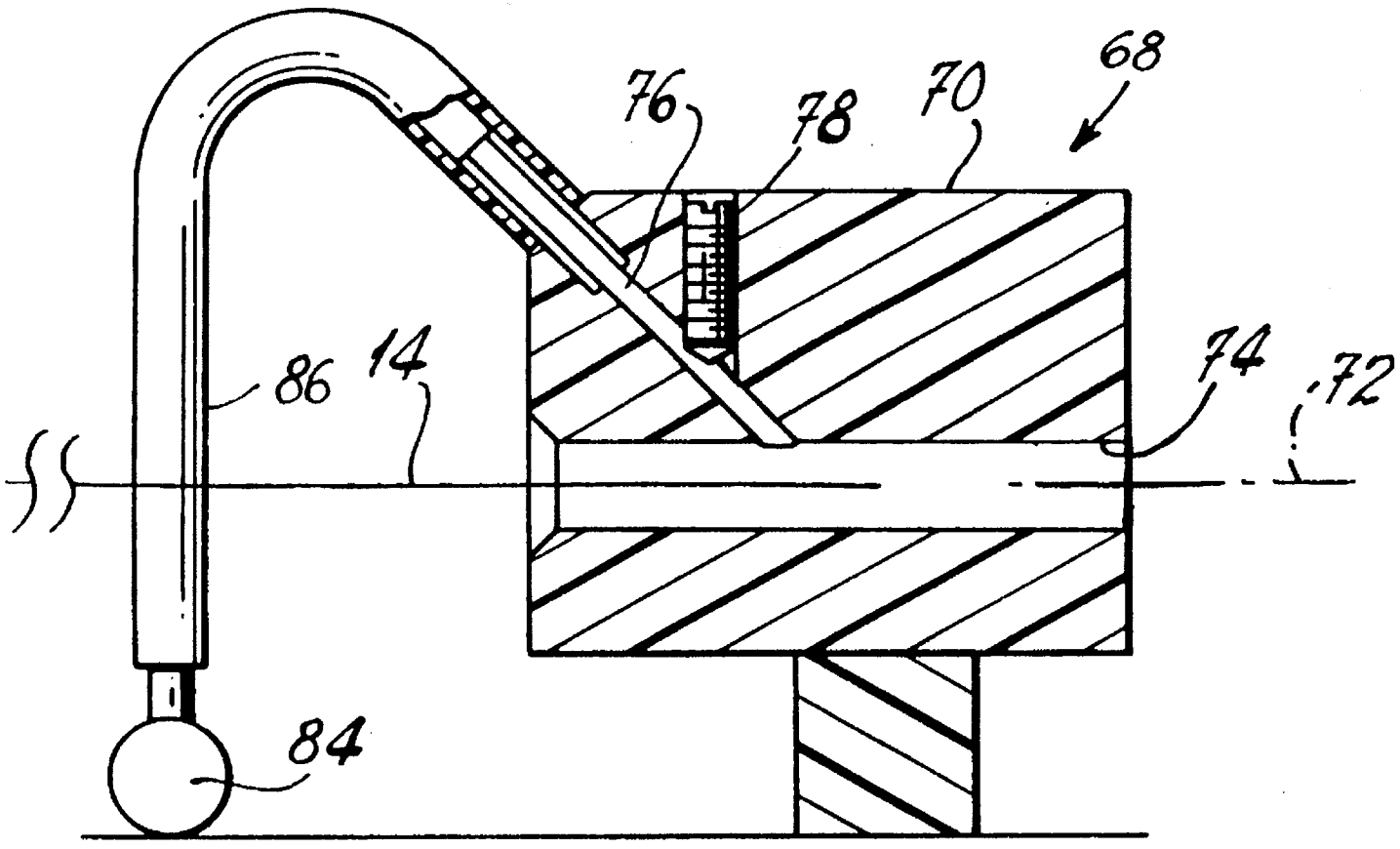
FIG. 5 is an elevational, sectional view of the air drying component.

The agitator components 26 are mounted upon ribs 46 via bolts 48 (only one of which is shown, in FIG. 3) to provide free circulation of the respective fluids.

The detergent fluid can be maintained in a supply 48 positioned beneath first station 18 and can supply the detergent fluid thereto by means of a recirculating pump, not shown, via supply tube 50, carrier tubes 52, feed tubes 54 and return lines 56.

A similar arrangement can provide the aqueous rinse from a supply 58 via supply tube 60, carrier tubes 62, feed tubes 64 and return lines 66.

The air drying components 68 of the third station 22 are similar to the those of the first and second station, comprising a body 70 having a longitudinal axis 72 and a wire strand receiving bore 74 extending therethrough and coaxial with the longitudinal axis. First fluid receiving passage 76 is located at an end of the body and connects with bore 74 at an angle of less than 90° and greater than 0°. The fluid receiving passage 76 is provided with a fluid volume control 78 which can be in the form of an adjustable set screw.

An air compressor 80 can supply air via tubes 82, carriers 84 and feed tubes 86.

The wire strand feed 24 for pulling the wire strands 14 through the cleaner is shown diagramatically. Any common conveyance Can be utilized and the strand feed need not be immediately adjacent the cleaner; for example, a wire annealing furnace can be interposed therebetween.

Utilization of this wire strand cleaner avoids the use of chlorofluoro carbons and yet provides complete control over the cleaning of the wire. The adjustability of the fluid flow provides a wide range of turbulence which insures good cleaning of the wire.

While there have been shown and described what are at present considered to be the preferred embodiments of the invention, it will be apparent to those skilled in the art that various changes and modifications can be made herein without departing from the scope of the invention as defined by the appended claims.

What is claimed is:

1. An agitator component for use with a wire strand cleaner comprising; a body having a longitudinal axis; a wire strand receiving bore coaxial with said longitudinal axis; a first fluid receiving passage connecting with said bore at an angle less than 90° and greater than 0° ; a fluid volume control adjustably mounted with said first fluid receiving passage; and a fluid releasing path having upper and lower ends formed in said body, normal to said bore and in communication therewith, said fluid releasing path being open to the environment at both its upper and lower ends.

2. The agitatior component of claim 1 wherein said body has a second fluid receiving passage connecting with said bore at an angle less that 90° and greater than 0°.

3. The agitator component of claim 2 wherein said first fluid receiving passage and said second fluid receiving passage are at opposite ends of said body and are each directed toward said fluid releasing path.

4. The agitator component of claim 3 wherein said fluid volume control comprises a threaded member adjustable into and out of said fluid receiving passage.

* * * * *